US005542464A

United States Patent [19]

Shiina

[11] Patent Number: 5,542,464

[45] Date of Patent: Aug. 6, 1996

[54] ROLLER BLIND WITH SCREEN ROLLED UP BY A SPRING AND ROLLED DOWN BY HAND

[75] Inventor: Nobuhiro Shiina, Tokyo, Japan

[73] Assignee: Toso Company, Limited, Tokyo, Japan

[21] Appl. No.: 256,270

[22] PCT Filed: Nov. 24, 1993

[86] PCT No.: PCT/JP93/01713

§ 371 Date: Sep. 26, 1994

§ 102(e) Date: Sep. 26, 1994

[87] PCT Pub. No.: WO94/12757

PCT Pub. Date: Jun. 9, 1994

[30] Foreign Application Priority Data

Nov. 30, 1992 [JP] Japan ..... 4-082200 U
Apr. 20, 1993 [JP] Japan ..... 5-092799

[51] Int. Cl.[6] ..... E06B 9/56

[52] U.S. Cl. ..... 160/296; 160/321

[58] Field of Search ..... 160/307, 321, 160/319, 296, 305, 313, 323.1, 299, 8

[56] References Cited

U.S. PATENT DOCUMENTS

| | | | |
|---|---|---|---|
| 4,188,992 | 2/1980 | Segerljung | 160/296 |
| 4,372,432 | 2/1983 | Waine et al. | 160/307 X |
| 4,751,953 | 6/1988 | Appel et al. | 160/321 X |
| 4,779,662 | 10/1988 | Wilk | 160/321 |
| 4,865,109 | 9/1989 | Sherman | 160/321 |
| 5,167,269 | 12/1992 | Abo | 160/321 X |

FOREIGN PATENT DOCUMENTS

| | | | |
|---|---|---|---|
| 59-152382 | 10/1984 | Japan . | |
| 63-10198 | 1/1988 | Japan . | |
| 63-34950 | 7/1988 | Japan . | |
| 63-41516 | 10/1988 | Japan . | |
| 63-50385 | 12/1988 | Japan . | |
| 1-25191 | 7/1989 | Japan . | |
| 1-26871 | 8/1989 | Japan . | |
| 3-16399 | 4/1991 | Japan . | |
| 3-30678 | 5/1991 | Japan . | |
| 2126637 | 3/1984 | United Kingdom | 160/313 |

*Primary Examiner*—David M. Purol

[57] ABSTRACT

A clutch-brake type roll blind is provided with a wind-up spring for rolling up a screen on a tube and a weight bar free from a pulling string, being suitable for use with a tall window extending from floor to ceiling. The roll blind includes a rotary shaft fitted in the tube for rotation therewith and projecting therefrom, a pulley rotatably mounted on the rotary shaft, and an endless ball chain drivingly hung down from the pulley. The pulley can rotate the tube only when the ball chain is pulled down in the direction in which the screen is rolled down from the tube.

6 Claims, 3 Drawing Sheets

ROLLER BLIND WITH SCREEN ROLLED UP BY A SPRING AND ROLLED DOWN BY HAND

TECHNICAL FIELD

The present invention relates to improvements in a roll blind in which tile screen is pulled down by hand and rolled up by a wind-up spring.

BACKGROUND OF THE INVENTION

JP Y S63-41516 and JP Y H1-26871 disclose a roll blind in which the screen is pulled down by hand and rolled up by a winding spring. The roll blind comprises a tube for rolling up the screen thereon, a fixed shaft for rotatably supporting one end portion of the tube, a wind-up spring interposed between the tube and the Fixed shaft, a clutch brake interposed between the tube and the fixed shaft for selectively rotating the tube. The screen is usually provided at its free end with a weight bar. The clutch brake allows the tube to roll down the screen therefrom, when the weight bar is pulled down. The clutch brake prevents the tube from rolling the screen down therefrom and up thereon, when the weight bar is released after being substantially lowered. However, the clutch brake again allows the tube to be rotated by the wind-up spring in the direction in which the screen is rolled up on the tube, when the weight bar is released after being slightly lowered. While the screen is rolled up by the winding spring, its speed can be reduced by the use of a reduction mechanism interposed between the tube and the fixed shaft. The clutch brake as described above is disclosed by JP B S63-34950. The aforementioned reduction mechanism is disclosed by JP Y H1-26871.

When the roll blind is mounted in a tall window which extend from a floor to a ceiling, the weight bar is usually provided with a pulling string. The string enables one to operate the roll blind even if the screen is rolled up at a high position beyond one's reach. However, when the screen is lowered near the full length of the floor, the string inconveniently lies on tile floor.

The present invention is intended to solve the problem as described above by providing a corded roll blind in which a pulling string is eliminated from the weight bar.

SUMMARY OF THE INVENTION

The present invention included in a roll blind comprising a tube for rolling up a screen thereon, a fixed shaft for rotatably supporting one end portion of the tube, a clutch brake interposed between the tube and the fixed shaft for selectively rotating the tube, a wind-up spring interposed between the tube and the fixed shaft for rotating the tube in the direction in which the screen is rolled up on the tube, a rotary shaft connected with the tube for rotation therewith and projecting therefrom, a pair of brackets for supporting the fixed and rotary shafts, a pulley drivingly engaged with the rotary shaft for rotating the tube, an endless pulling member drivingly engaged with the pulley and hung therefrom to a manually operatable position. The pulling member is arranged to rotate the tube in the direction in which tile screen is lowered through the intermediary of the pulley. The combination of the pulling member with tile pulley may be a cord with a cord wheel, a belt with a belt pulley, a rope with a rope wheel, or a ball chain with a ball chain wheel.

In the case of tile pulley integrally formed with the tube, the clutch brake will bear an undesirable force when the pulling member is drawn by mistake in the direction in which the screen is rolled up on the tube. Accordingly, it is preferable to provide a one-way clutch device between the tube and the pulley in a manner such that no torque acts on the clutch brake when the pulling member is drawn in the counter direction. The one-way clutch device can be a sprag, ratchet, cam, or coil-spring type.

The blind would have the pulley secured to the tube without the one-way clutch device, if it can be made known to everyone without exception that the pulling member must be drawn in tile direction in which the screen is lowered. The clutch brake should bear the undesirable torque to prevent the tube from rotating when the pulling member is drawn in the counter direction by mistake.

When the weight bar or endless pulling member is drawn down in the direction in which the screen is rolled down, the clutch brake allows the tube to rotate in the direction in which tile screen is rolled down therefrom. When the weight bar or the pulling member is released after being substantially drawn, the clutch brake prevents the tube from rotating, so that tile weight bar remains at a position lowered from the initial position. When the weight bar or the pulling member is released after being slightly drawn, the clutch brake again allows the tube to be rotated by the wind-up spring in the direction in which the screen is rolled up on the tube. The conventional pulling string is eliminated from the weight bar, because the endless pulling member is always hung from the pulley at an easily operatable position.

The reduction mechanism can be removed from the blind, if the endless pulling member always moves together with the tube when the screen is rolled up on the tube. The reason for this is that one can reduce the wind-up speed by giving a hand-touch Friction to the endless pulling member.

The advantages offered by the present invention are that one can operate the screen of the roll blind by manipulating the weight bar or the endless pulling member. The endless pulling member always hangs at an easily operatable position higher than the floor. Accordingly, the weight bar is free from the conventional pulling string which inconveniently lies on the floor when the screen is rolled down near the floor. The roll blind further comprises a one-way clutch interposed between the tube and the pulley so that the pulley can rotate the tube when the endless pulling member is drawn in the direction in which the screen is rolled down but not when drawn in the counter direction. When the endless pulling member is drawn in the counter direction by mistake, the pulley rotates freely so that no undesirable torque acts on the clutch brake. Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

Figure 1:
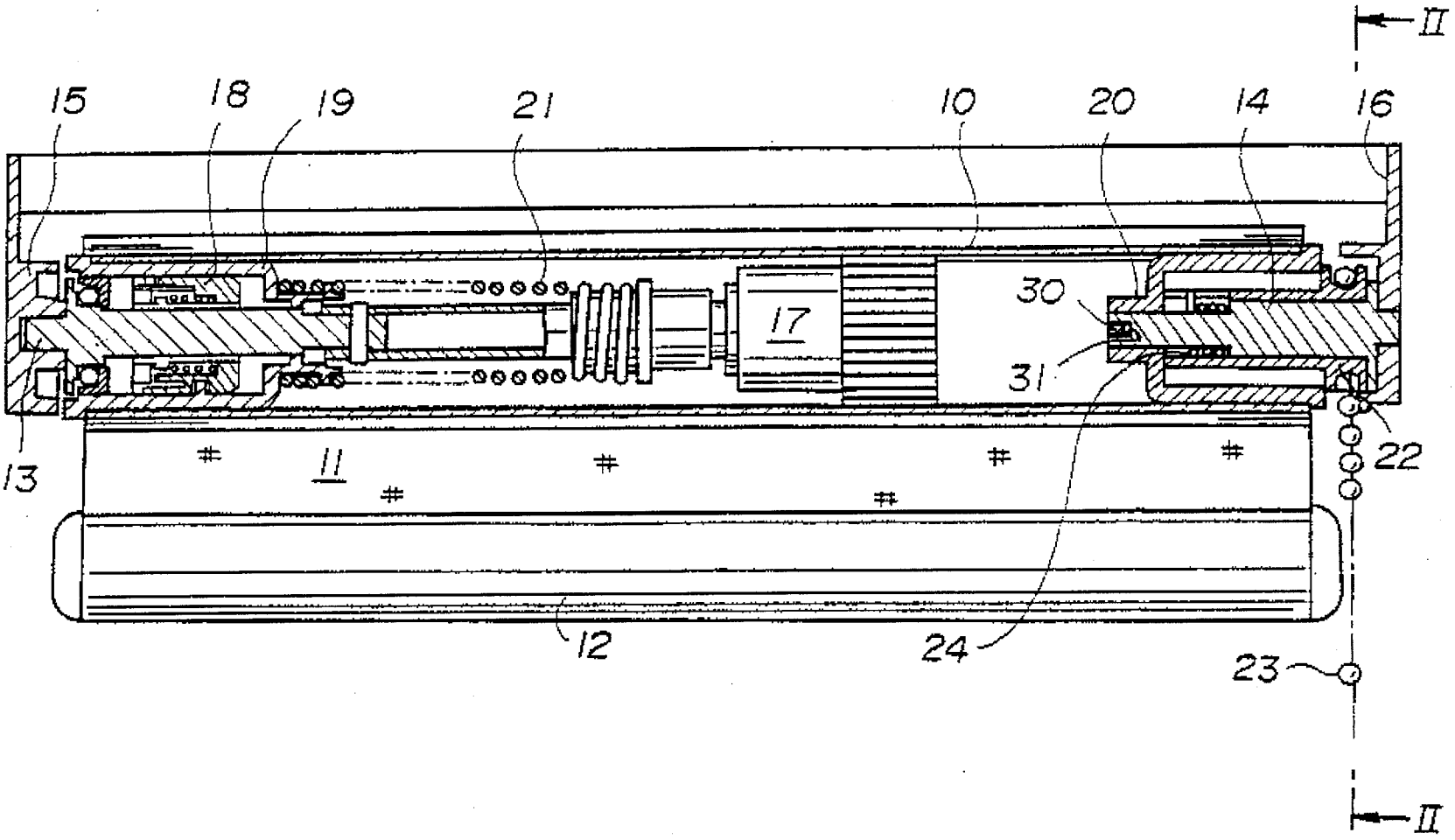
FIG. 1 is a front elevational view of the relevant portion of the roll blind according to the invention.
Figure 4:
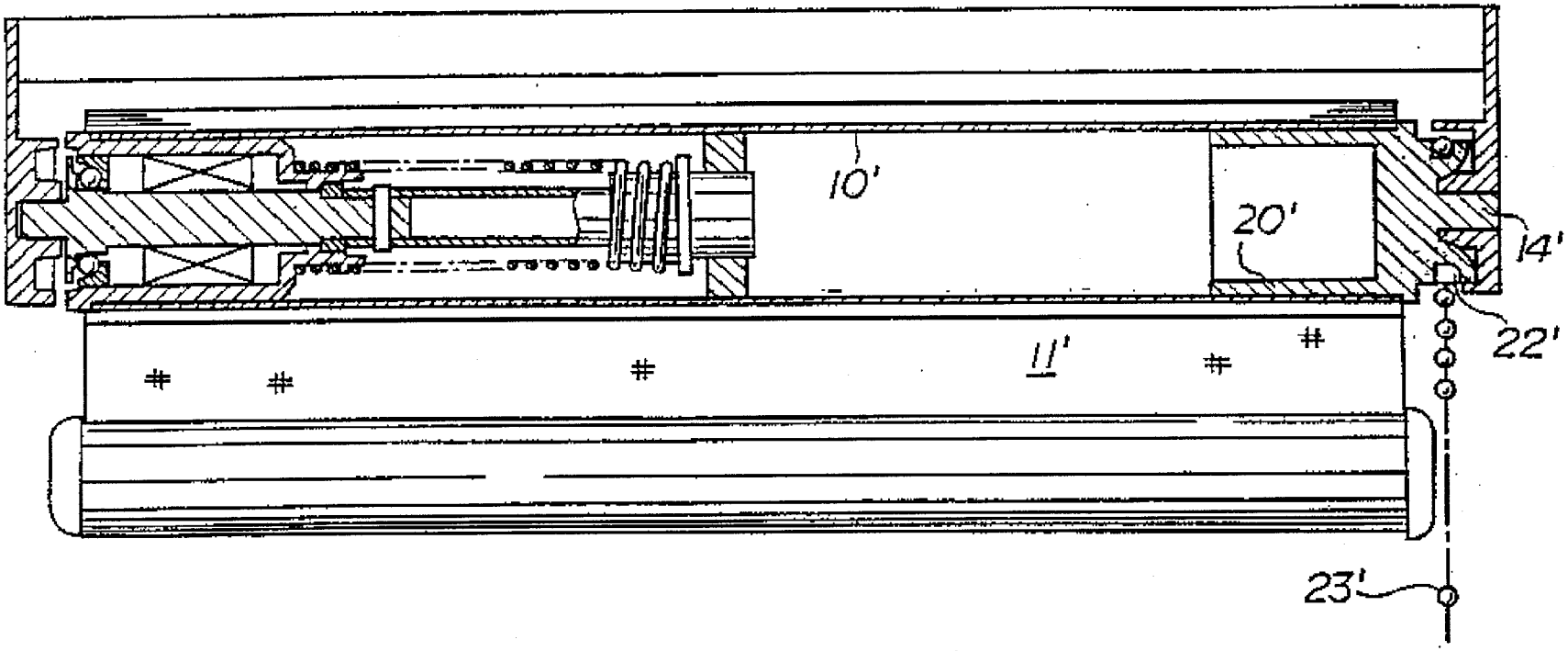

FIG, 3 is a fragmentary perspective view of a one-way clutch device of FIG. 1;

FIG. 4 is an elevational view, similar to FIG. 1, of another embodiment.

DETAILED DESCRIPTION OF THE PREFERRED EMBODIMENTS

The present invention will be explained by way of example with reference to the drawings.

Figure 2:
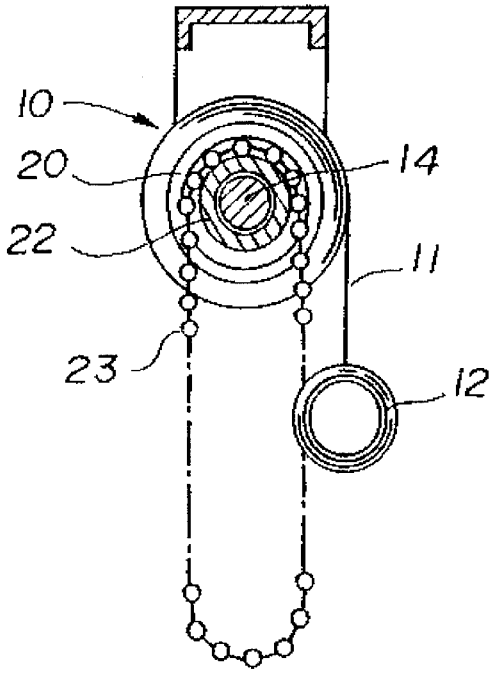
FIG. 2 is a sectional view taken along the line II—II of FIG. 1.

As seen in FIGS. 1 and 2, the roll blind has a tube 10 on which a screen 11 is rolled up. The screen 11 has its free end attached to a weight bar 12. The tube 10 has one end portion fitted on a fixed shaft 13 and the other end portion fitted on a rotary shaft 14. The fixed shaft 13 is fixedly supported by a bracket 15. Tile rotary shaft 14 is rotatably supported by the other bracket 16.

The fixed shaft 13 has its inner end extending axially to a fixed part of a reduction gearing mechanism 17, of which the rotary part is connected to the inner surface of the tube 10 for rotation therewith. The one end portion of the tube 10 is fixedly fitted on an annular end piece 19. A clutch brake 18 has its fixed part fixedly fitted on the fixed shaft 13 and the rotary part connected to the inner surface of the annular end piece 19. A wind-up spring 21 is loosely fitted on the fixed shaft 13 and has one end thereof secured to the fixed shaft 13 and the other end attached to the end piece 19 of the tube 10. The clutch brake is the same as disclosed by JP B 63-34950. The aforementioned construction is similar to that used in the conventional clutch-brake type roll blind with a wind-up spring for rolling up a screen on a tube.

A pulley 22 is rotatably fitted on the rotary shaft 14 projecting from the other end of the tube 10. A ball chain 23 is drivingly engaged on the pulley 22. The ball chain hangs down at a position in which one can operate the chain with ease. The other end portion of the tube has the inner surface thereof secured to the other annular end piece 20, which is joined with the rotary shaft 14 for rotation therewith through the intermediary of a key 30 and a key groove 31. The key 30 and the key groove 31 are diametrally provided on the respective inner end surfaces of the end piece 20 and the rotary shaft 14 and detachably coupled with each other. A coil-spring type one-way clutch 24 is provided between the pulley 22 and the rotary shaft 14. The roll blind of the present invention has no pulling string as required for the conventional roll blind.

Figure 3:
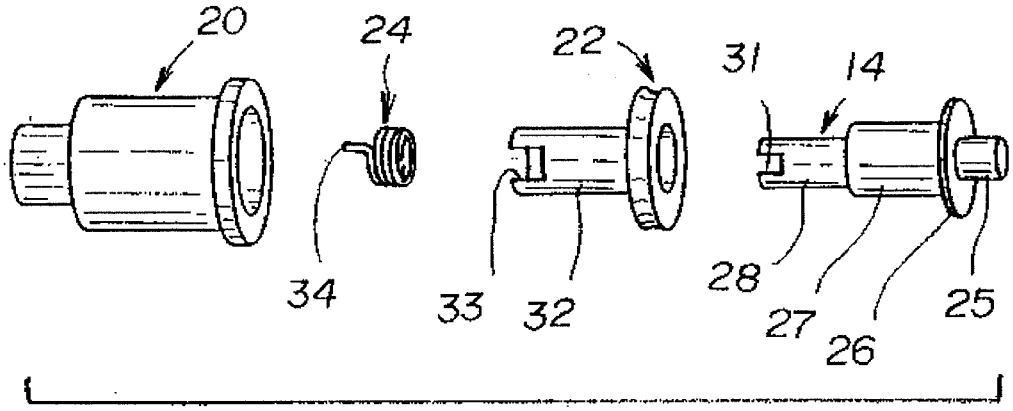

As seen in FIG. 3, the rotary shaft 14 has an outer axle 25 received in a bore in the bracket, a flange 26 in contact with the outer face of the pulley 22, a central axle 27 rotatably fitted in the bore of the pulley 22, and an inner axle 28 fitted in the coil spring of the one-way clutch 24. The inner axle 28 is formed at its end with a key groove 31 for coupling engagement with a key provided in the inner periphery of the end piece 20. The inner axle 28 of the rotary shaft 14 is diametrally smaller than the axle. The pulley 22 has its sleeve portion 32 extending to the inner axle 28 of the rotary shaft 14. The inner axle 28 is loosely fitted in the coil spring of the one-way clutch 24. The sleeve portion 32 at the inner end is formed with a slit 33 for fitting engagement with one end 34 of the coil spring of the one-way clutch 24.

The coil spring type one-way clutch 24 is so arranged that it tightly coils on the inner axle 28 of the rotary shaft 14 when the slit 33 causes the one end 34 to turn in the direction in which the screen is rolled down from the tube and uncoils from the inner axle 28 when the slit 33 causes the end 34 to turn in the counter direction. Accordingly, the pulley 22 is rotated in the direction in which the screen is drawn out, the coil spring type one-way clutch 24 allows the rotary shaft 14 or the tube to be rotated by the pulley 22. Alternatively, when the pulley 22 is rotated in the counter direction, the clutch device 24 prevents the rotary shaft 14 or the tube from being rotated by the pulley 22 with the result that the pulley 22 fails to rotate and the pulley 22 idles on the rotary shaft 14.

As seen in FIGS. 1 and 2, when the ball chain 23 is pulled down in the direction in which the tube 10 rolls down the screen, the coil spring 24 seizes the rotary shaft 14 and allows the tube 10 to rotate with the pulley 22, resulting in the screen 11 being rolled down from the tube 10. While the tube 10 rolls down the screen 11 therefrom, the clutch brake 18 is disengaged. When the ball chain 23 is released after being substantially drawn, the clutch brake 18 acts to prevent the rotation of the tube 10 with the result that the screen 11 remains unmoved at a position lowered from the initial position. Thereafter, when the ball chain 23 is slightly drawn and then released, the clutch brake 18 is disengaged again so that the wind-up spring 21 rotates the tube 10 in the direction in which the screen is rolled up on the tube. While the screen is rolled up, the wind-up speed is controlled by the use of the reduction gearing mechanism 17.

When the ball chain is pulled down in the counter direction, the coil spring 24 uncoils from the rotary shaft 14 with the result that the pulley 22 idles on the rotary shaft 14 without rotating the tube 10. The coil spring type one-way clutch may be substituted for any other type one-way clutch.

When the weight bar 12 is within one's reach, one can operate either the weight bar 12 or the ball chain to raise and lower the screen. When one pulls down the weight bar 12 to roll down the screen 11 from the tube 10, the pulley 22 will rotate together with the tube 10 if the ball chain is not prevented from moving. But, if the ball chain is prevented from moving by hand, the coil spring 24 uncoils from the rotary shaft so that the pulley 22 remains unmoved and slips on the rotary shaft.

The blind of FIG. 4 is not provided with a one-way clutch or a reduction gearing mechanism. It has a tube 10' secured to such an end piece 20' that is integrally formed with the rotary shaft 14' and the pulley 22'. The ball chain 23' always moves together with the tube 10'. One can control the wind-up speed of the screen 11' by giving a proper hand friction to the ball chain 23' when the screen is raised.

As seen in FIG. 2, the ball chain 23 always hangs at a position in which one can operate it with ease to raise or lower the screen 11. Thus, it is possible to eliminate the conventional pulling string as attached to the weight bar 12 even if the roll blind is mounted in a tall window such that the weight bar is raised beyond one's reach.

The roll blind of the invention is used as a manually operatable shade for a window in a house, and suitable in particular to control the light from a tall window extending from the floor to the ceiling. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A roller blind comprising:

a tube having a first end portion and a second end portion;

a screen located on said tube and adapted to be rolled up on said tube;

a fixed shaft for rotatably supporting said first end portion of said tube;

a clutch brake interposed between said tube and said fixed shaft for selectively rotating said tube;

a wind-up spring interposed between said tube and said fixed shaft for rotating said tube in a first direction in which said screen is rolled up on said tube;

a reduction gearing mechanism having a first portion fixed to said fixed shaft and a second portion connected to said tube for reducing the speed at which said screen is rolled up by said wind-up spring;

a rotary shaft fitted in said second end portion of said tube for rotation therewith and projecting partly therefrom;

a pulley drivingly engaged with said rotary shaft; and a pulling member drivingly hung from said pulley.

2. The roller blind according to claim 1, wherein said pulley is coupled with said tube through a one-way clutch device such that said pulley can rotate said tube only when said pulling member is drawn in a direction in which said screen is unrolled.

3. The roller blind according to claim 2, wherein said pulley is rotatably fitted on said rotary shaft, and wherein said one-way clutch device includes a coil spring fitted on said rotary shaft such that said coil spring coils on said rotary shaft when said pulley is rotated in a direction in which said screen is unrolled and uncoils from said rotary shaft when said pulley is rotated in a direction in which said screen is rolled up.

4. The roller blind according to claim 1, wherein said pulling member is a ball chain.

5. The roller blind according to claim 1, wherein said pulling member is an endless pulling member.

6. The roller blind according to claim 1, and further including a pair of brackets for supporting said fixed and rotary shafts.

* * * * *